US009650222B2

(12) United States Patent
Tokoro

(10) Patent No.: US 9,650,222 B2
(45) Date of Patent: May 16, 2017

(54) IMAGE FORMING APPARATUS

(71) Applicant: Brother Kogyo Kabushiki Kaisha, Nagoya-shi, Aichi-ken (JP)

(72) Inventor: Yuji Tokoro, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/789,143

(22) Filed: Jul. 1, 2015

(65) Prior Publication Data

US 2016/0010734 A1 Jan. 14, 2016

(30) Foreign Application Priority Data

Jul. 8, 2014 (JP) ..... 2014-140233

(51) Int. Cl.

| | |
|---|---|
| ***G03G 15/20*** | (2006.01) |
| ***B65H 7/20*** | (2006.01) |
| ***B65H 3/06*** | (2006.01) |
| ***B65H 7/02*** | (2006.01) |

(52) U.S. Cl.

CPC ..... *B65H 7/20* (2013.01); *B65H 3/0669* (2013.01); *B65H 7/02* (2013.01); *G03G 15/2017* (2013.01); *G03G 15/2032* (2013.01); *G03G 15/2064* (2013.01)

(58) Field of Classification Search

None

See application file for complete search history.

(56) References Cited

U.S. PATENT DOCUMENTS

| | | | | |
|---|---|---|---|---|
| 6,082,912 | A * | 7/2000 | Shimizu | B41J 23/025 400/120.01 |
| 8,538,307 | B2 | 9/2013 | Hisano | |
| 2008/0118262 | A1* | 5/2008 | Kinouchi | G03G 15/2039 399/69 |
| 2012/0027477 | A1* | 2/2012 | Nakayama | G03G 15/2064 399/328 |
| 2012/0163887 | A1* | 6/2012 | Hisano | G03G 15/2032 399/331 |
| 2015/0003871 | A1* | 1/2015 | Takahashi | G03G 15/2064 399/122 |

FOREIGN PATENT DOCUMENTS

| | | |
|---|---|---|
| JP | H07-129018 A | 5/1995 |
| JP | 2009-282401 A | 12/2009 |
| JP | 2011-059260 A | 3/2011 |

* cited by examiner

*Primary Examiner* — Sevan A Aydin

(74) *Attorney, Agent, or Firm* — Banner & Witcoff, Ltd.

(57) ABSTRACT

An image forming apparatus includes a motor, a first conveyer and a second conveyer to nip and convey a recordable medium, an urging member to urge one of the first and second conveyers toward the other, a cam member driven by a driving force from the motor to change intensities of pressure in a nipping area, a first gear system to transmit the driving force to the first conveyer, a second gear system to transmit the driving force to the cam member, an engaging member being engaged with a cam gear to rotate integrally and being one of a worm gear and a one-way gear, and a swing gear swingable between a first position, in which the swing gear transmits the driving force to the first gear system, and a second position, in which the swing gear transmits the driving force to the second gear system.

20 Claims, 14 Drawing Sheets

IMAGE FORMING APPARATUS

CROSS REFERENCE TO RELATED APPLICATION

This application claims priority from Japanese Patent Application No. 2014-140233 filed on Jul. 8, 2014, the entire subject matter of which is incorporated herein by reference.

BACKGROUND

Technical Field

An aspect of the present invention relates to an image forming apparatus.

Related Art

An image forming apparatus having a fixing unit, which may apply pressure to a sheet having a toner image formed thereon so that the toner image is fixed onto the sheet, is known. The image forming apparatus may be equipped with a motor, of which rotating directions is switchable between a normal direction and a reverse direction in order to activate or inactivate the fixing unit.

SUMMARY

The image forming apparatus may have a swing gear, which is movable to swing back and forth according to the rotating directions of the motor. When the motor rotates in the normal direction, the swing gear may swing in one direction to activate the fixing unit, and when the motor rotates in the reverse direction, the swing gear may swing in the other direction to move a cam member to inactivate the fixing unit. For example, the fixing unit may be equipped with a pressurizing member and a pressed member, which may form a nipping area when the pressurizing member presses the pressed member. The fixing unit may be activated when the pressurizing member presses the pressed member and may be inactivated when the pressurizing member and the pressed member are separated by the cam member from each other.

According to an aspect of the present disclosure, an image forming apparatus is provided. The image forming apparatus includes a motor; a motor gear disposed on the motor; a first conveyer; a first gear system connected with the first conveyer; a second conveyer arranged to oppose the first conveyer; a second gear system connected with the second conveyer; a first pressed member; a first cam member including a first cam face and a second cam face, a first distance between the first cam face and a rotation center of the first cam member being shorter than a second distance between the second cam face and the rotation center of the first cam member, the first cam member being arranged to contact the first pressed member; a first cam gear disposed on the first cam member and configured to rotate integrally with the first cam member; a first urging member arranged to contact the first pressed member, the first urging member urging the first pressed member toward the first cam member, the first urging member being connected with the second conveyer, the first urging member urging the second conveyer toward the first conveyer; a swing gear engaged with the motor gear, the swing gear being configured to swing between a first position, in which the swing gear engages with the first gear system, and a second position, in which the swing gear engages with the second gear system; and a first engaging gear directly engaged with the first cam gear, the first engaging gear being one of a worm gear and a one-way gear, the first engaging gear being configured to be driven by the second gear system and drive the first cam gear when the swing gear is in the second position and to be stationary when the swing gear is in the first position.

According to still another aspect of the present disclosure, an image forming apparatus is provided. The image forming apparatus includes a motor; a first conveyer configured to be driven by a driving force from the motor, the first conveyer being configured to convey a recordable medium; a second conveyer configured to form a nipping area to nip the recordable medium in conjunction with the first conveyer; an urging member configured to urge one of the first and second conveyers toward the other of the first and second conveyers; a cam member configured to be driven by the driving force from the motor to affect the urging member, the cam member being configured to change intensities of pressure to be generated in the nipping area; a first gear system configured to transmit the driving force from the motor to the first conveyer; a second gear system configured to transmit the driving force from the motor to the cam member; an engaging member engaged with a cam gear disposed on the cam member to rotate integrally with the cam member, the engaging member being one of a worm gear and a one-way gear; and a swing gear configured to swing between a first position, in which the swing gear transmits the driving force from the motor to the first gear system, and a second position, in which the swing gear transmits the driving force from the motor to the second gear system.

BRIEF DESCRIPTION OF THE ACCOMPANYING DRAWINGS

Figure 4A:
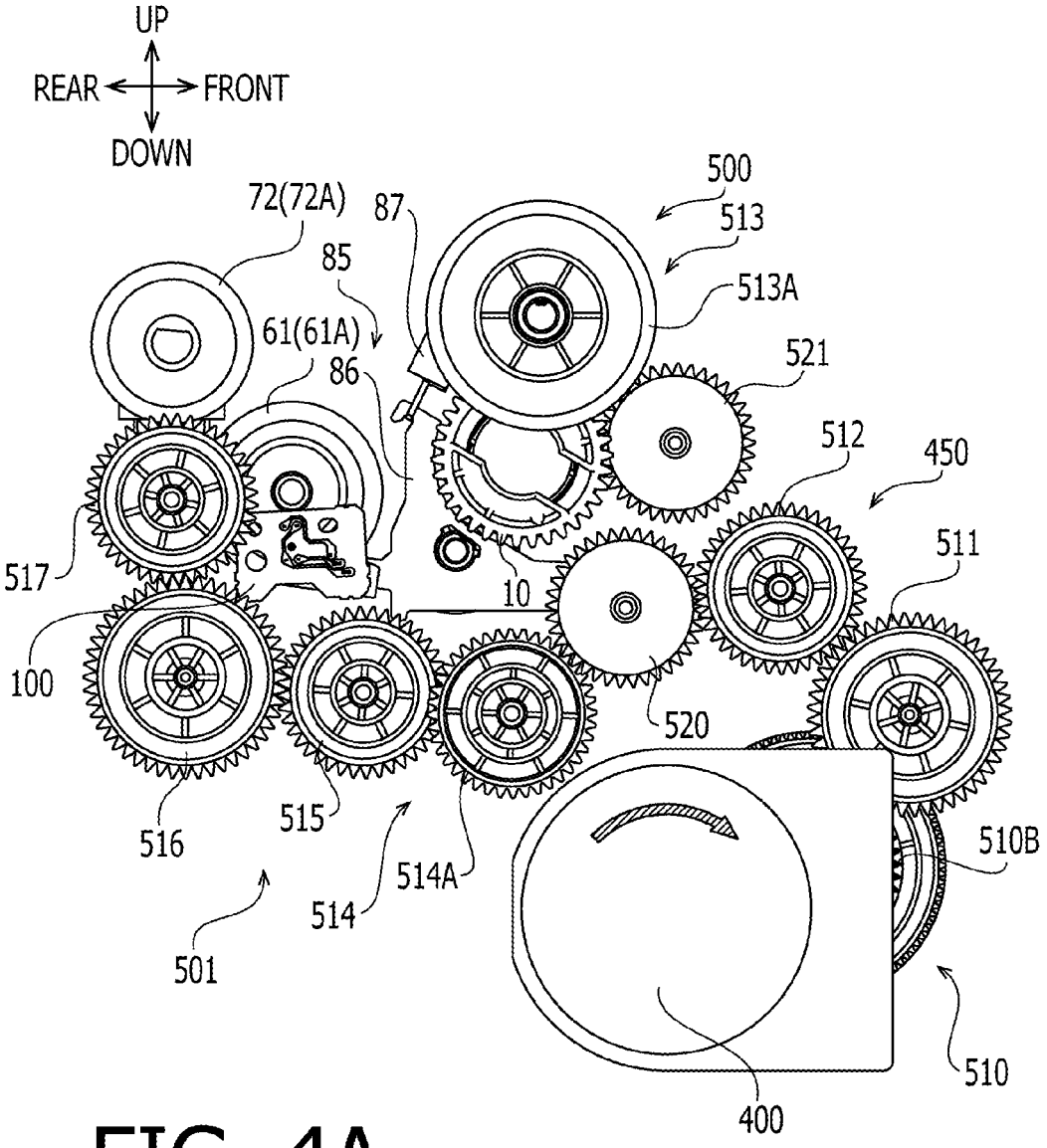
Figure 4B:
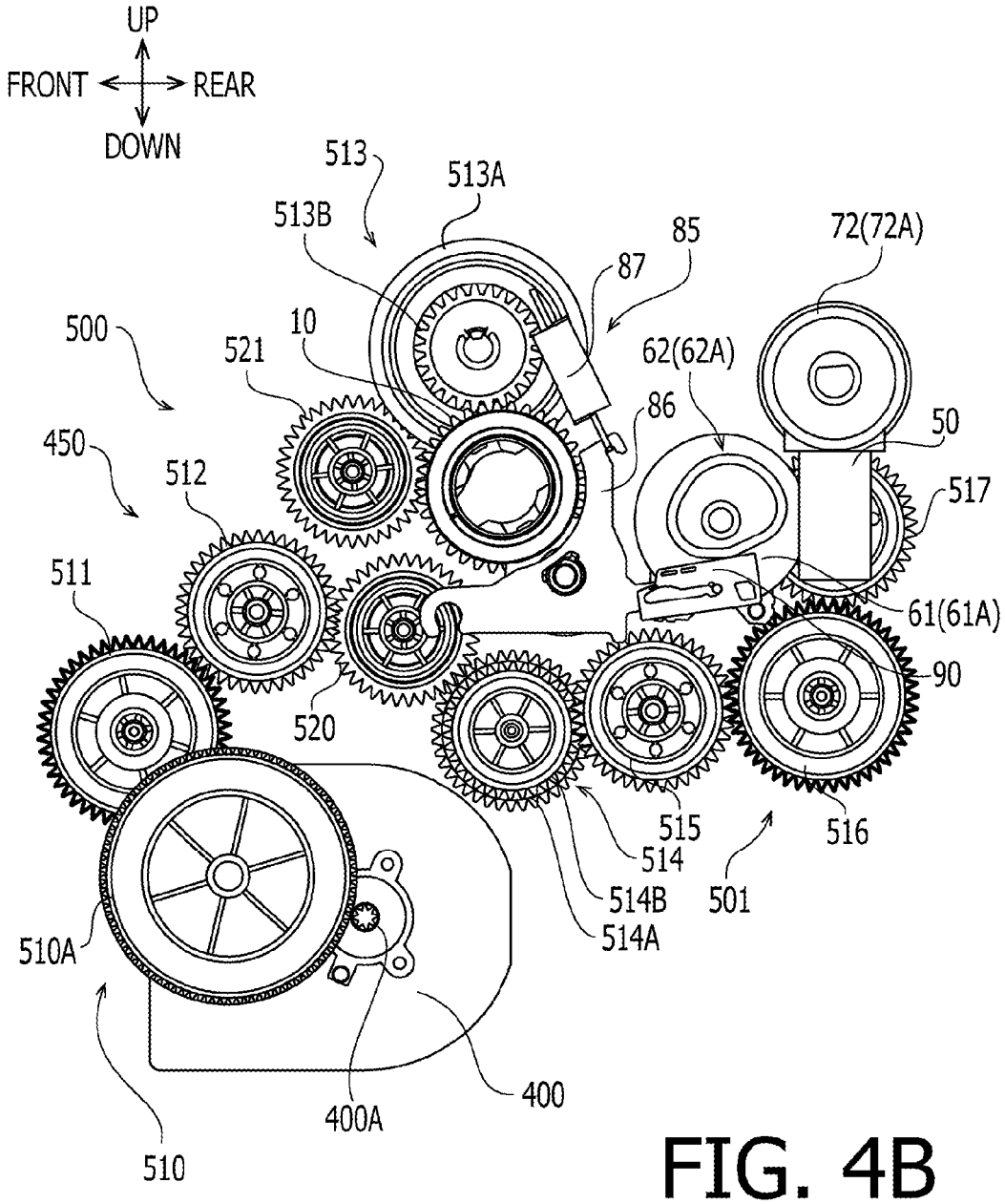

FIG. 4A is a right-front view of the first gear system and the second gear system when the motor rotates in a reverse direction in the fixing unit according to the embodiment of the present disclosure. FIG. 4B is a left-side view of the first gear system and the second gear system when the motor rotates in the reverse direction in the fixing unit according to the embodiment of the present disclosure.

Figure 5:
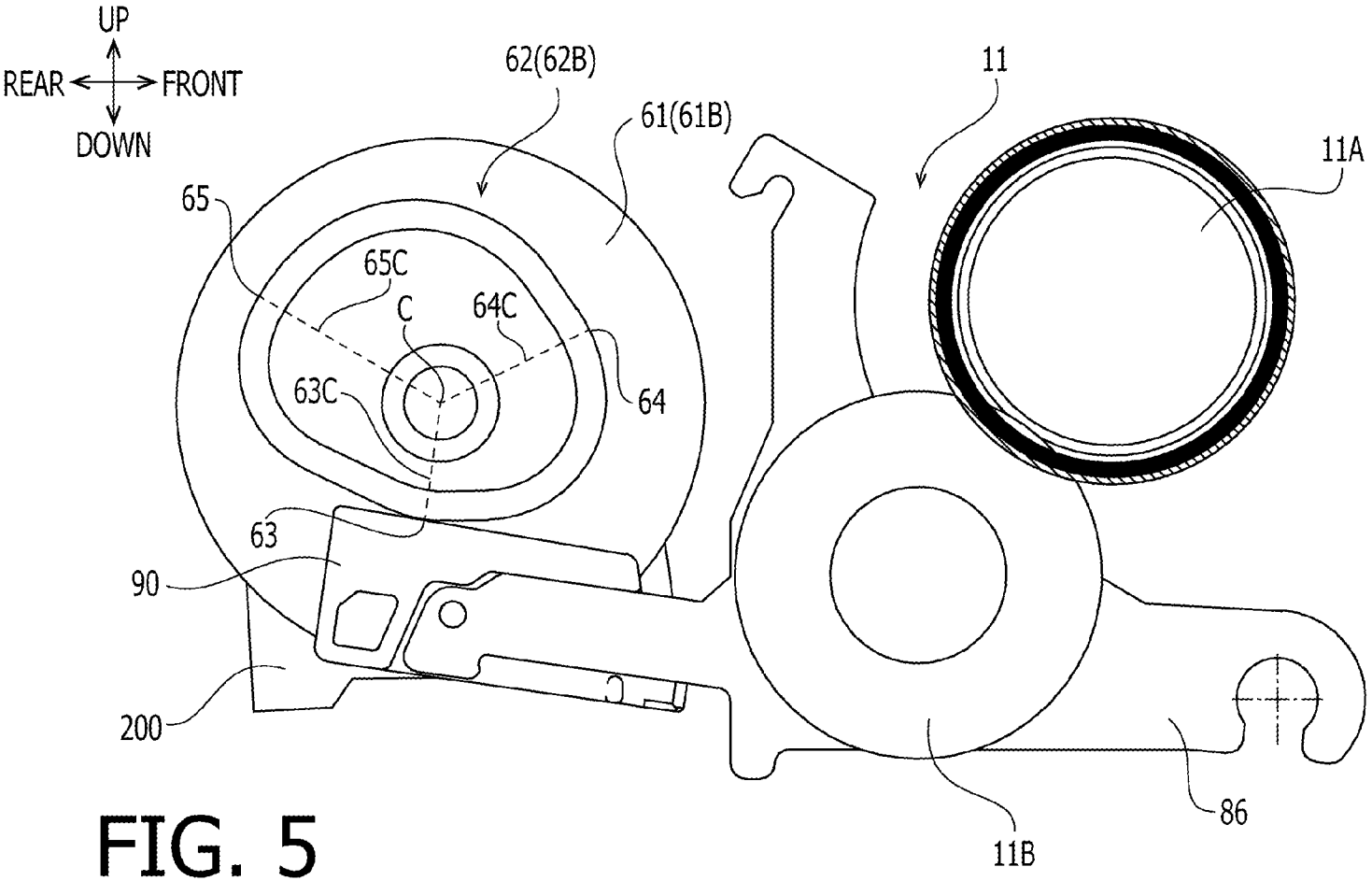

FIG. 5 is a side view of a main part including a cam member when a first intensity of pressure is generated in a nipping area in the fixing unit according to the embodiment of the present disclosure.

Figure 6A:
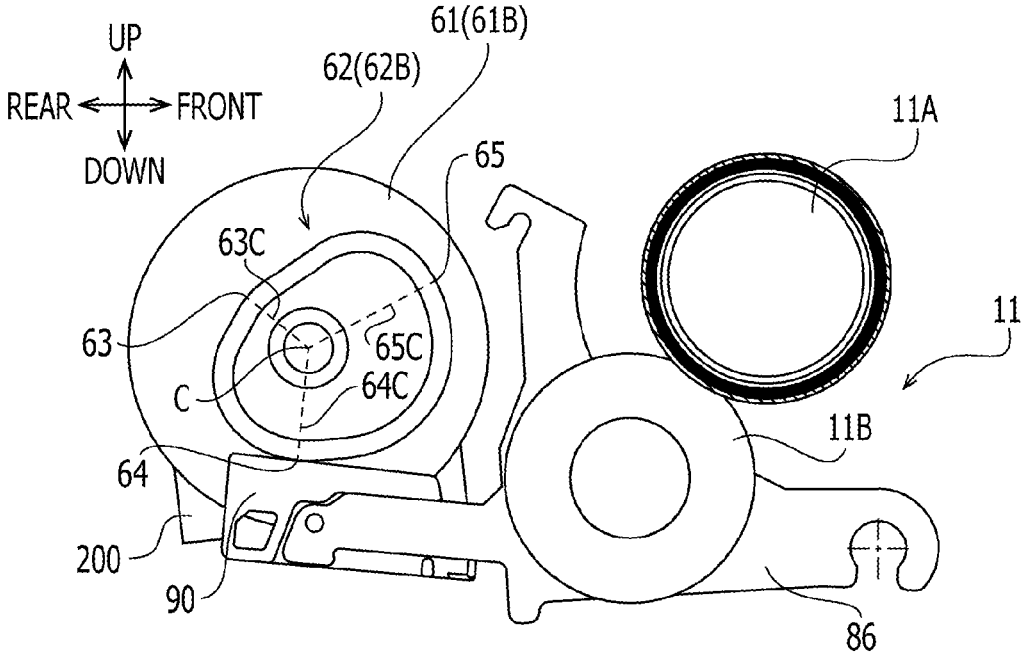
Figure 6B:
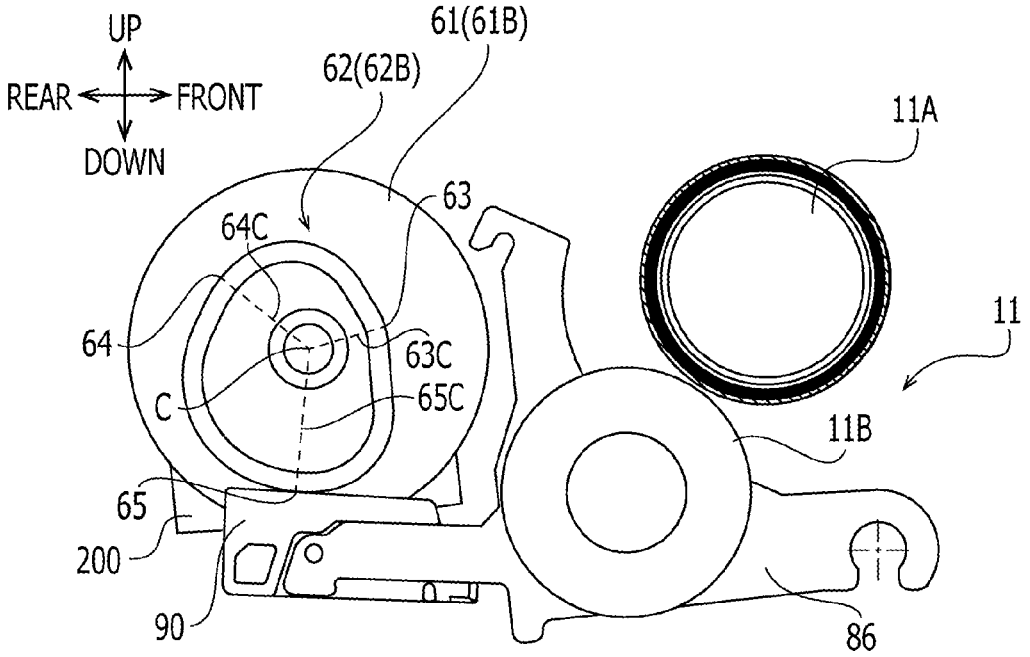

FIG. 6A is a side view of the main part including the cam member when a second intensity of pressure is generated in the nipping area in the fixing unit according to the embodiment of the present disclosure. FIG. 6B is a side view of the main part of the cam member when a third intensity of pressure is generated in the nipping area in the fixing unit according to the embodiment of the present disclosure.

Figure 7A:
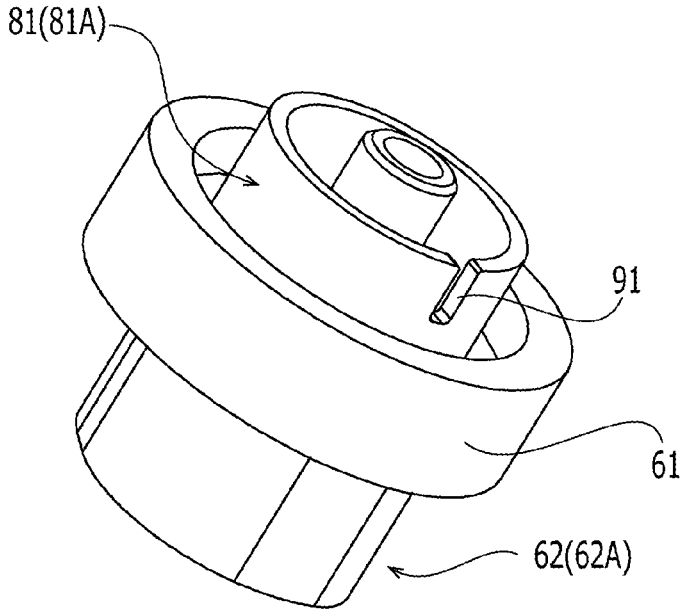
Figure 7B:
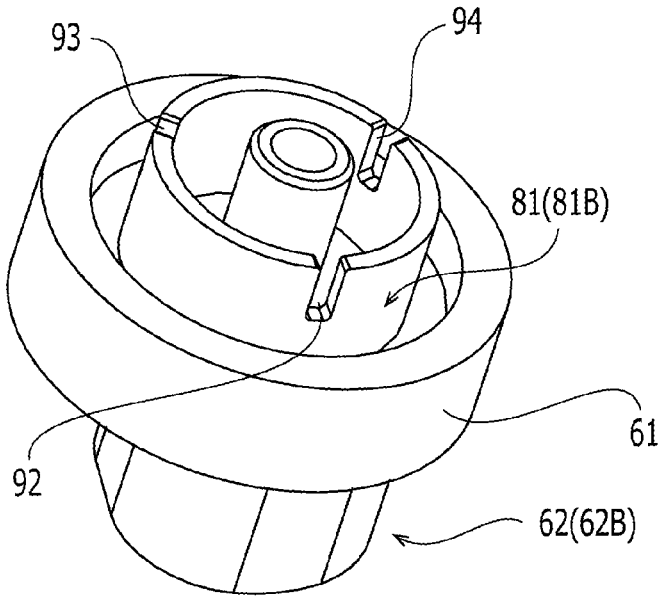

FIG. 7A is a perspective view of the cam member on the left with a slit according to the embodiment of the present disclosure. FIG. 7B is a perspective view of the cam member on the right with slits according to the embodiment of the present disclosure.

Figure 8:
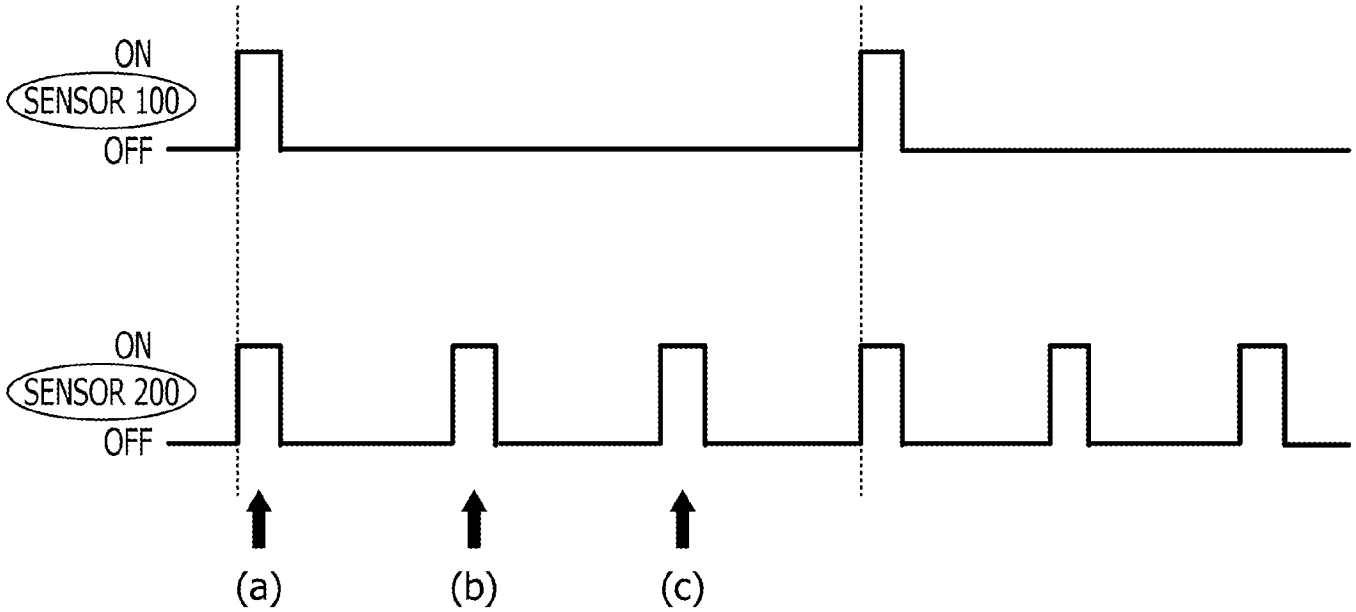

FIG. 8 illustrates a method related to control of the cam member according to the embodiment of the present disclosure.

Figure 9:
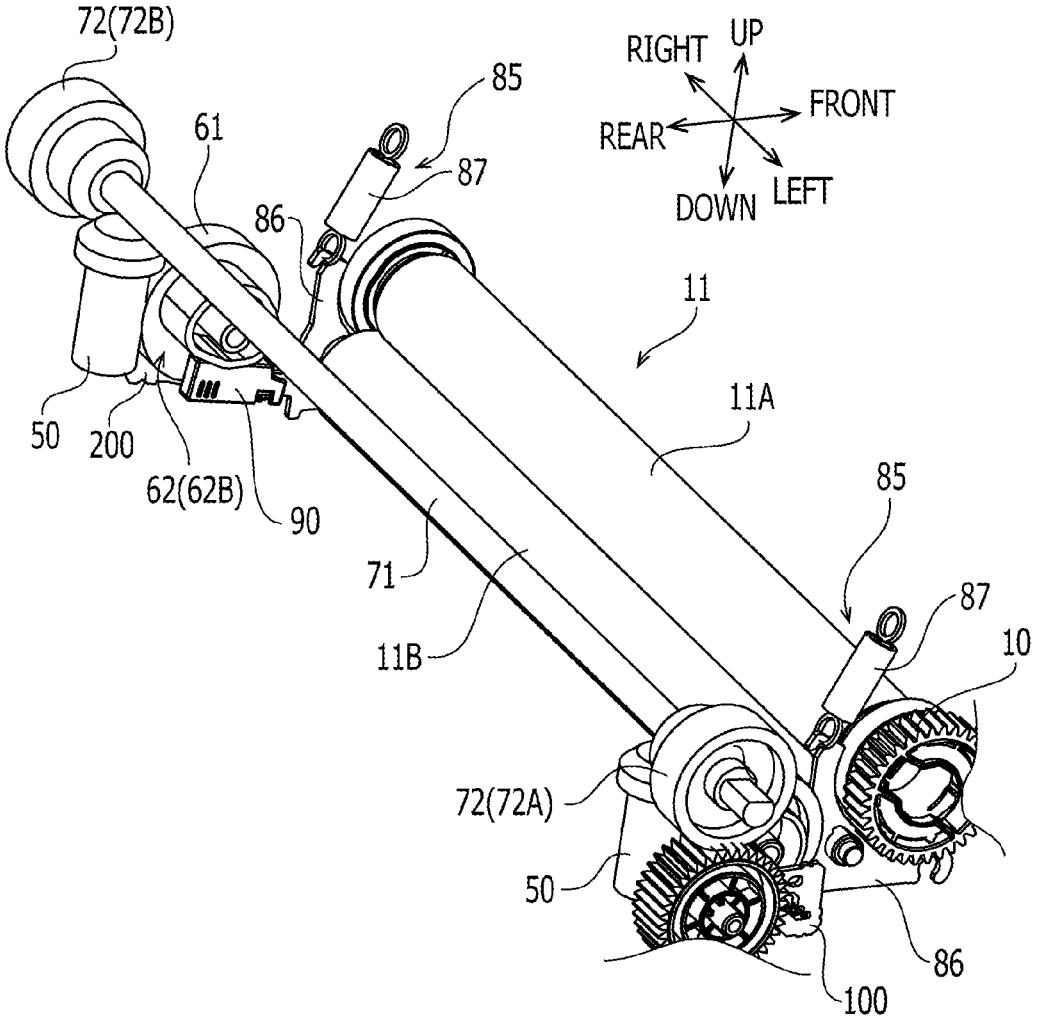

FIG. 9 is a perspective view to illustrate worm gears in the fixing unit according to the embodiment of the present disclosure.

Figure 10:
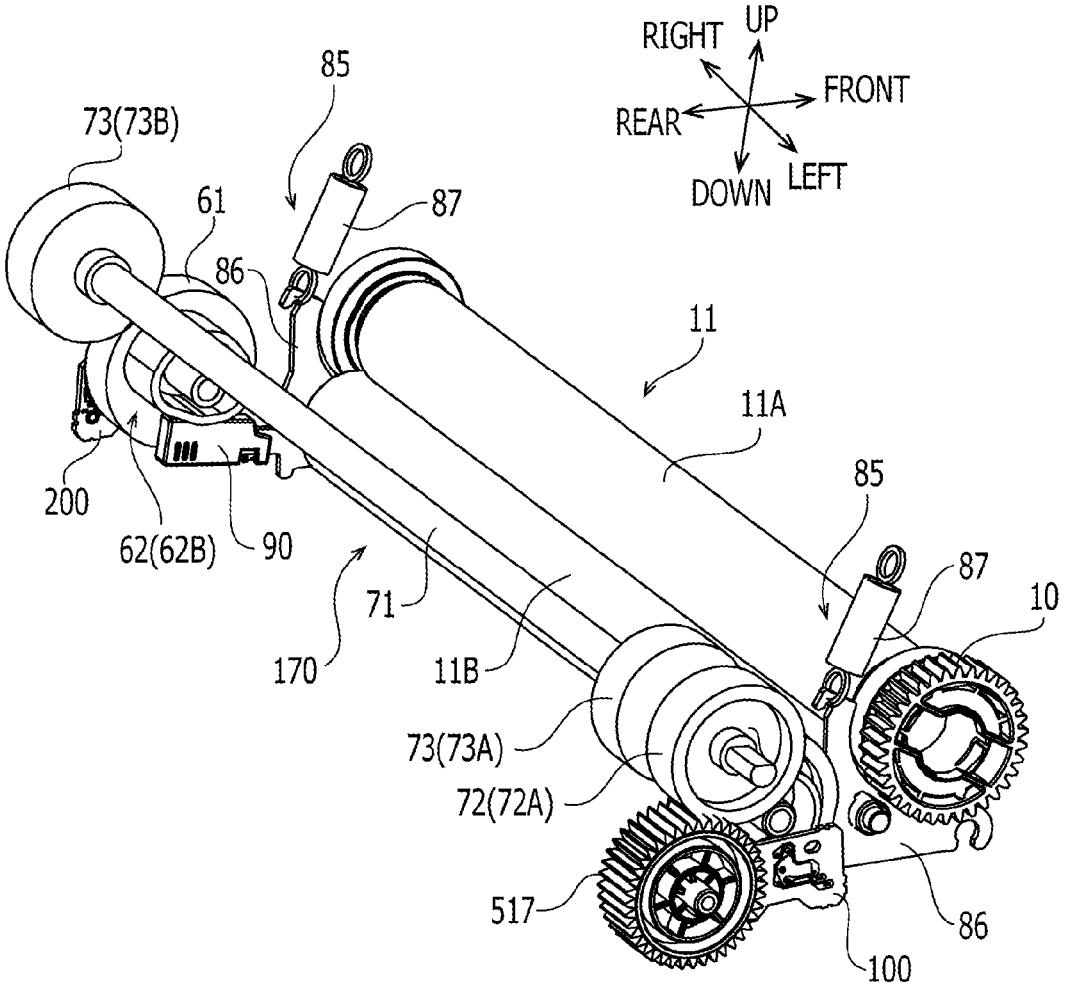

FIG. 10 is a perspective view to illustrate an example of an engaging member in the fixing unit according to the embodiment of the present disclosure.

Figure 11:
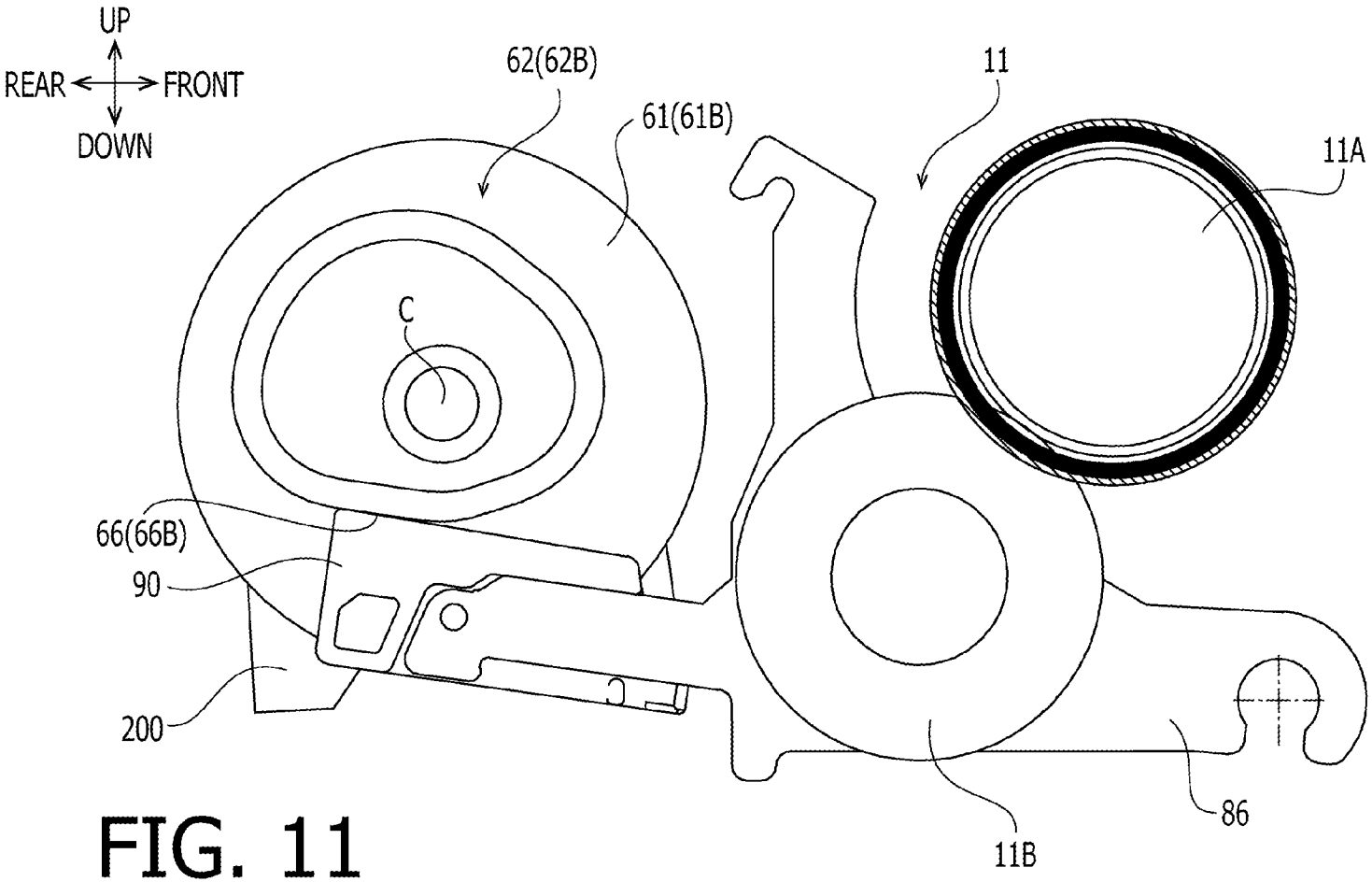

FIG. 11 is a side view of another example of the cam member according to the embodiment of the present disclosure.

Figure 12:
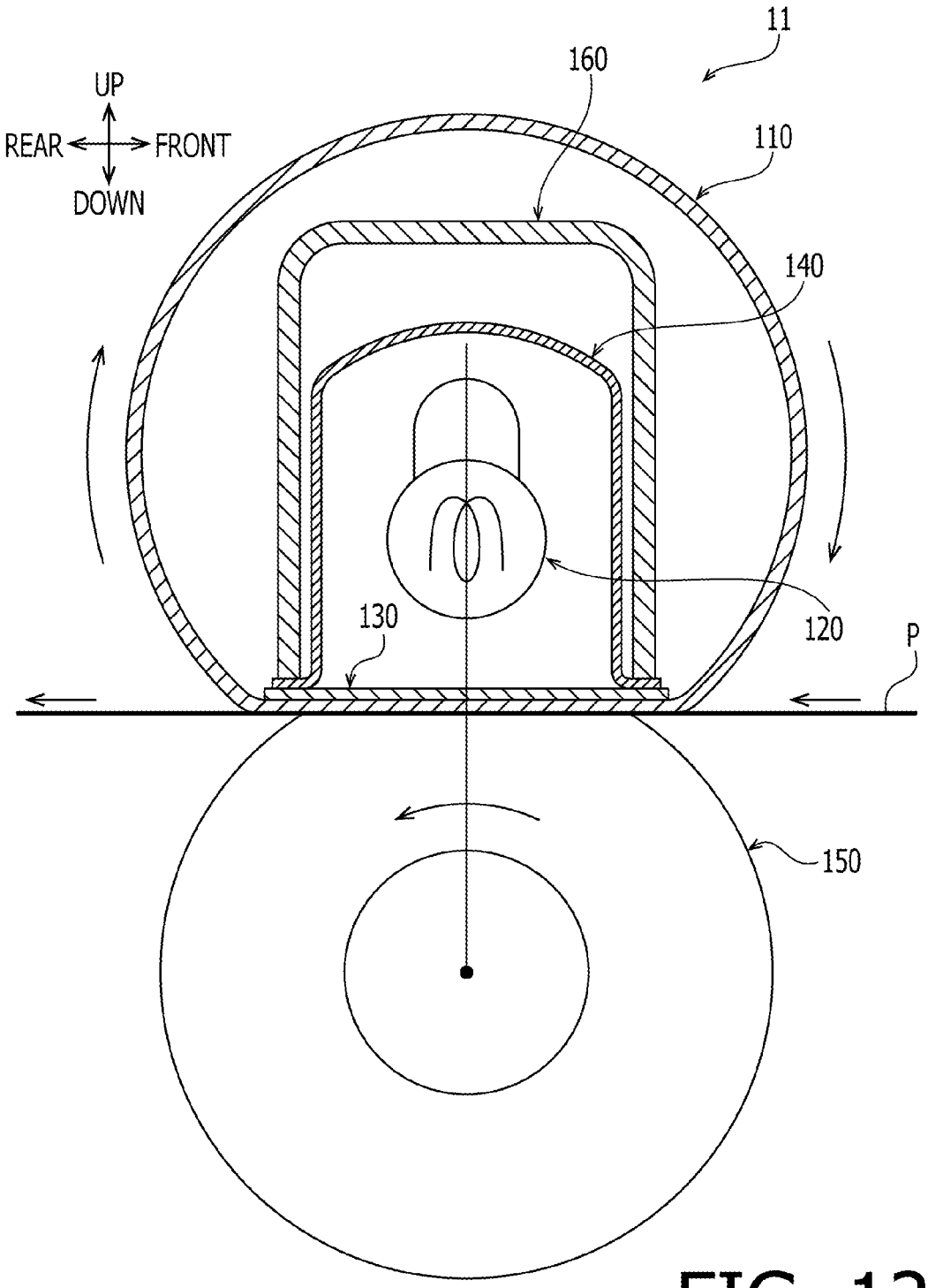

FIG. 12 is a cross-sectional view of another example of the fixing unit according to the embodiment of the present disclosure.

DETAILED DESCRIPTION

Figure 1:
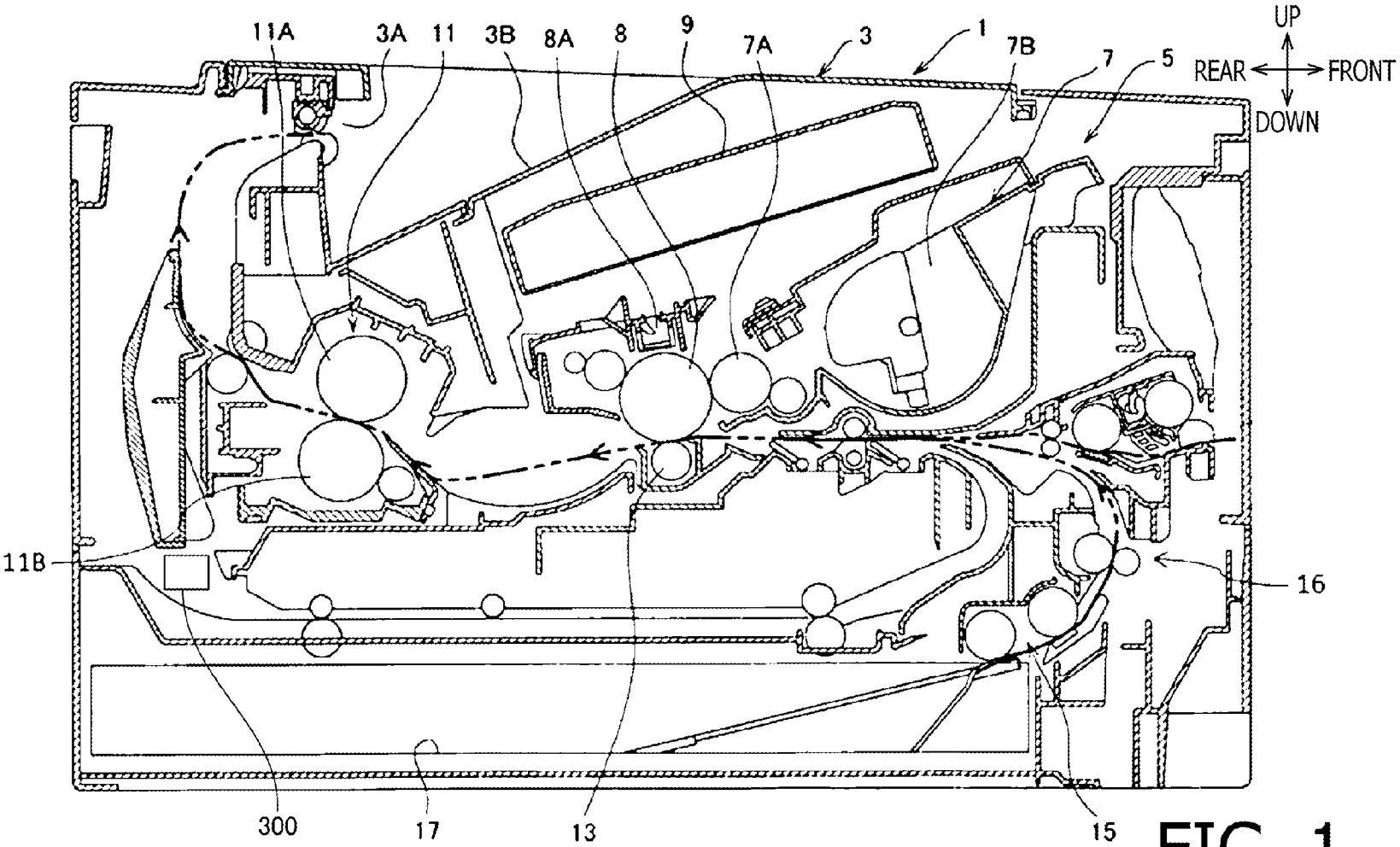
FIG. 1 is an illustrative cross-sectional view of an image forming apparatus according to an embodiment of the present disclosure.

Hereinafter, an exemplary configuration of an image forming apparatus 1 according to the embodiment of the present disclosure will be described with reference to the accompanying drawings. First, an overall configuration of the image forming apparatus 1 will be described, and a detailed configuration of the image forming apparatus 1 will be described later. In the following description, directions concerning the image forming apparatus 1 will be referred to in accordance with a user's ordinary position to use the image forming apparatus 1, as indicated by arrows in each drawing. For example, a viewer's right-hand side appearing in FIG. 1 is referred to as a front side of the image forming apparatus 1, and a left-hand side in FIG. 1 opposite from the front side is referred to as a rear side. A side which corresponds to the viewer's nearer side is referred to as a left-hand side or a left side for the user, and an opposite side from the left, which corresponds to the viewer's farther side is referred to as a right-hand side or a right side for the user. An up-down direction in FIG. 1 corresponds to a vertical direction of the image forming apparatus 1. Further, the right-to-left or left-to-right direction of the image forming apparatus 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-6, and 8-12 are similarly based on the orientation of the image forming apparatus 1 as defined above and correspond to those with respect to the image forming apparatus 1 shown in FIG. 1 even when the drawings are viewed from different angles.

FIG. 1 is an illustrative cross-sectional view of the image forming apparatus 1 according to an embodiment of the present disclosure. As shown in FIG. 1, the image forming apparatus 1 includes a chassis 3, a feeder tray 17, and an image forming unit 5. The chassis 3 is formed in an approximate shape of a rectangular box, and the feeder tray 17 is disposed in the chassis 3 to contain recordable medium such as sheets of recording paper and OHP sheets. The image forming unit 5 is configured to form images on the sheets fed from the feeder tray 17. The chassis accommodates the feeder tray 17 and the image forming unit 5. In the following description, the recordable medium such as recording paper and OHP sheets may be referred to as a "sheet" or "sheets."

The image forming unit 5 forms images on the sheets by transferring images formed in a developer agent onto the sheets. The image forming unit 5 includes a processing cartridge 7, an exposure unit 9, and a fixing unit 11.

The feeder tray 17 is detachably attached to the chassis 3. The sheets stored in the feeder tray 17 are fed by a first feeder 15, which is disposed on a downstream side of the feeder tray 17 with regard to a sheet conveying direction, to the image forming unit 5. The sheets fed by the first feeder 15 are conveyed to the image forming unit 5 by a first conveyer 16, which is disposed on a downstream side of the first feeder 15 with regard to the sheet conveying direction.

As the sheets conveyed from the feeder tray 17 reach the image forming unit 5, images formed in the developer agent based on image data are transferred onto the sheets.

The processing cartridge 7 includes a toner container 7B to contain toner being a developer agent, a photosensitive drum 8 to carry a toner image, a charger 8A to electrically charge the photosensitive drum 8, a developer roller 7A to develop a latent image formed on the photosensitive drum 8, and a transfer roller 13 to transfer the toner image formed on the photosensitive drum 8 onto the sheet.

In the image forming unit 5, while the photosensitive drum 8 rotates, a surface of the photosensitive drum 8 is evenly charged by the charger 8A and selectively exposed to a laser beam emitted from the exposure device 9 according to image data so that electrical potentials in the exposed areas are lowered. Thus, a latent image corresponding to the image data is formed on the surface of the photosensitive drum 8.

Thereafter, the toner in the toner container 7B is supplied to the photosensitive drum 8 by the developer roller 7A, and a toner image is formed on the surface of the photosensitive drum 8. When the sheet is conveyed through a position between the photosensitive drum 8 and the transfer roller 13, the toner image is transferred onto the sheet by the transfer roller 13.

The sheet with the transferred toner image is further conveyed to the fixing unit 11. The fixing unit 11 may include a first roller 11A and a second roller 11B. The first roller 11A conveys the sheet, which has been heated by a heater (not shown). The second roller 11B is arranged to face with the first roller 11A and forms a nipping area, in which the sheet is nipped and pressed between the first roller 11A and the second roller 11B. The second roller 11B, in conjunction with the first roller 11A, conveys the sheet.

In this regard, however, the fixing unit 11 may not necessarily be equipped with the first roller 11A and the second roller 11B. Alternatively, for example, as shown in FIG. 12, the fixing unit 11 may be equipped with a film to fix the images. The film-using fixing unit may include a fixing film 110 rolled in a cylindrical form, a halogen lamp 120 disposed inside the fixing film 110, a nipper board 130 disposed to slidably contact an inner surface of the fixing film 110, a reflection board 140 to reflect radiation heat from the halogen lamp 120 toward the nipper board 130, a pressure roller 150 that forms a nipping area to nip the fixing film 110 in conjunction with the nipper board 130, and a stay 160 to support the nipper board 130 at each end along the sheet conveying direction.

Referring back to FIG. 1, when the sheet with the transferred toner images is conveyed to the fixing unit 11 and passes through the position between the first roller 11A and the second roller 11B, the toner images on the sheet is thermally fixed thereat.

Thereafter, the sheet with the fixed toner images is ejected out of the chassis 3 and placed on a printed sheet tray 3B, which is arranged on top of the chassis 3. In the present embodiment, the image forming unit 5 employs the electrophotographic method to form images; however, the image forming unit 5 may optionally form images in inkjet-printing method.

Figure 2:
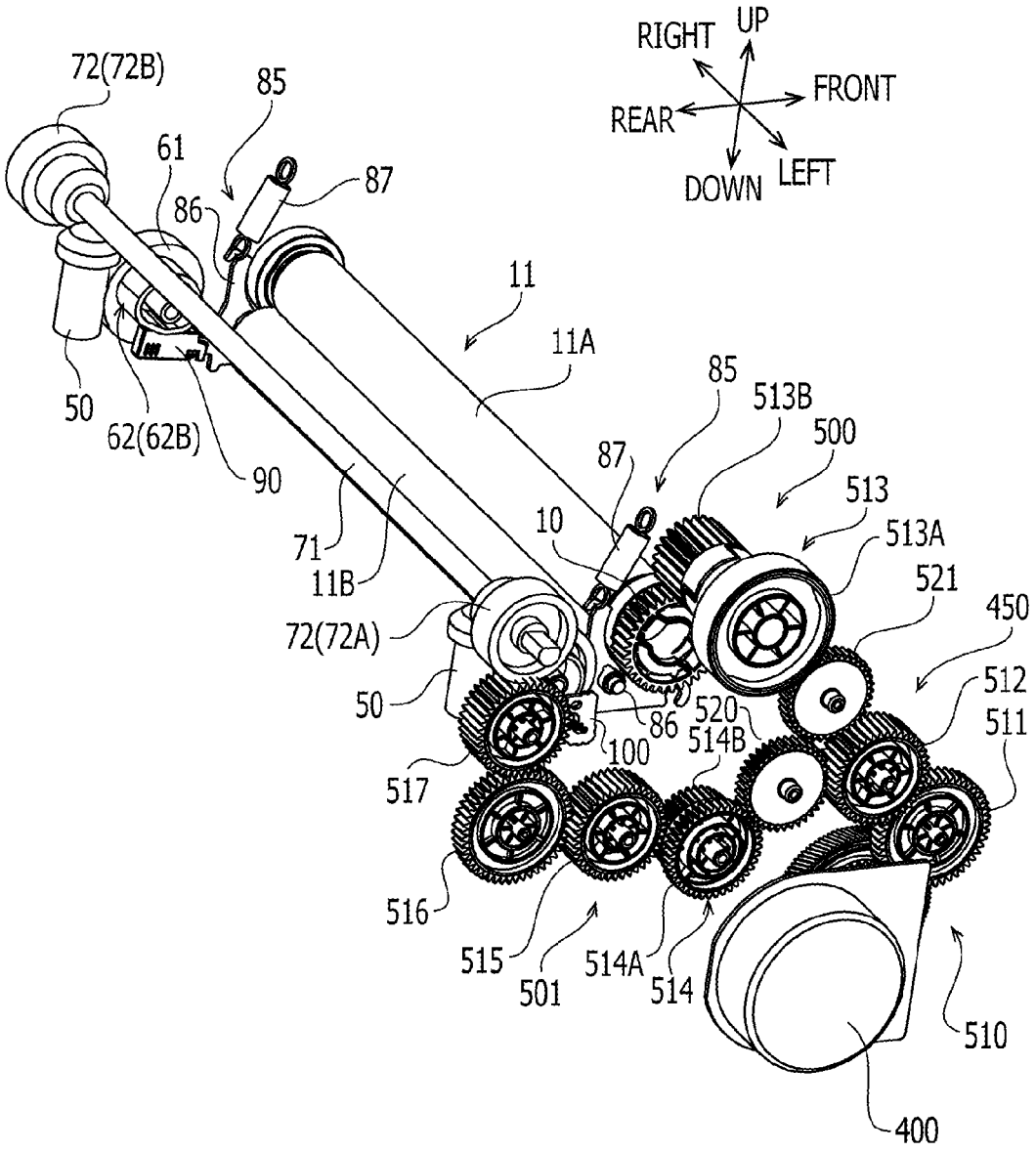
FIG. 2 is a perspective view of a fixing unit in the image forming apparatus according to the embodiment of the present disclosure.

Below will be described detailed configuration of the fixing unit 11. FIG. 2 is a perspective view of the fixing unit 11 in the image forming apparatus 1 according to the embodiment of the present disclosure. As shown in FIG. 2, the first roller 11A is a cylindrical roller, which longitudinally extends along the widthwise direction. The second roller 11B is arranged to face with the first roller 11A and is a cylindrical roller longitudinally extending along the widthwise direction.

At each widthwise end of the second roller 11B, arranged is an urging device 85, which urges the second roller 11B toward the first roller 11A. Each urging device 85 includes an urging member 86 to urge the second roller 11B toward the first roller 11A, a spring 87 to urge the urging member 86 upward, and a pressed member 90 which is disposed at a rear end of the urging member 86. The second roller 11B includes projections (unsigned), which project sideward along the widthwise direction from each widthwise end of the second roller 11B. The projections are supported by the urging member 86 to be urged upward.

In the present embodiment, the urging device 85 urges the second roller 11B toward the first roller 11A. However, the urging device 85 may alternatively urge the first roller 11A toward the second roller 11B.

At a rear end of each urging device 85, disposed is a cam member 62. The cam members 62 change intensities of pressure to be generated in the nipping area formed between the first roller 11A and the second roller 11B. Each cam member 62 is formed to have a cam gear 61, and each cam gear 61 is integrally formed with the cam member 62.

The image forming apparatus 1 includes a motor 400, and a driving force from the motor 400 is transmitted to the cam members 62 via a second gear system 501.

Meanwhile, a first drive gear 10 to drive the first roller 11A is disposed on a leftward end of the first roller 11A. Thereby, the driving force from the motor 400 is transmitted to the first drive gear 10 via a gear train 450. In this regard, the first drive gear 10 to transmit the driving force from the motor 400 may not necessarily be disposed on the first roller 11A to drive the first roller 11A but may be disposed on the second roller 11B to drive the second roller 11B.

Figure 3A:
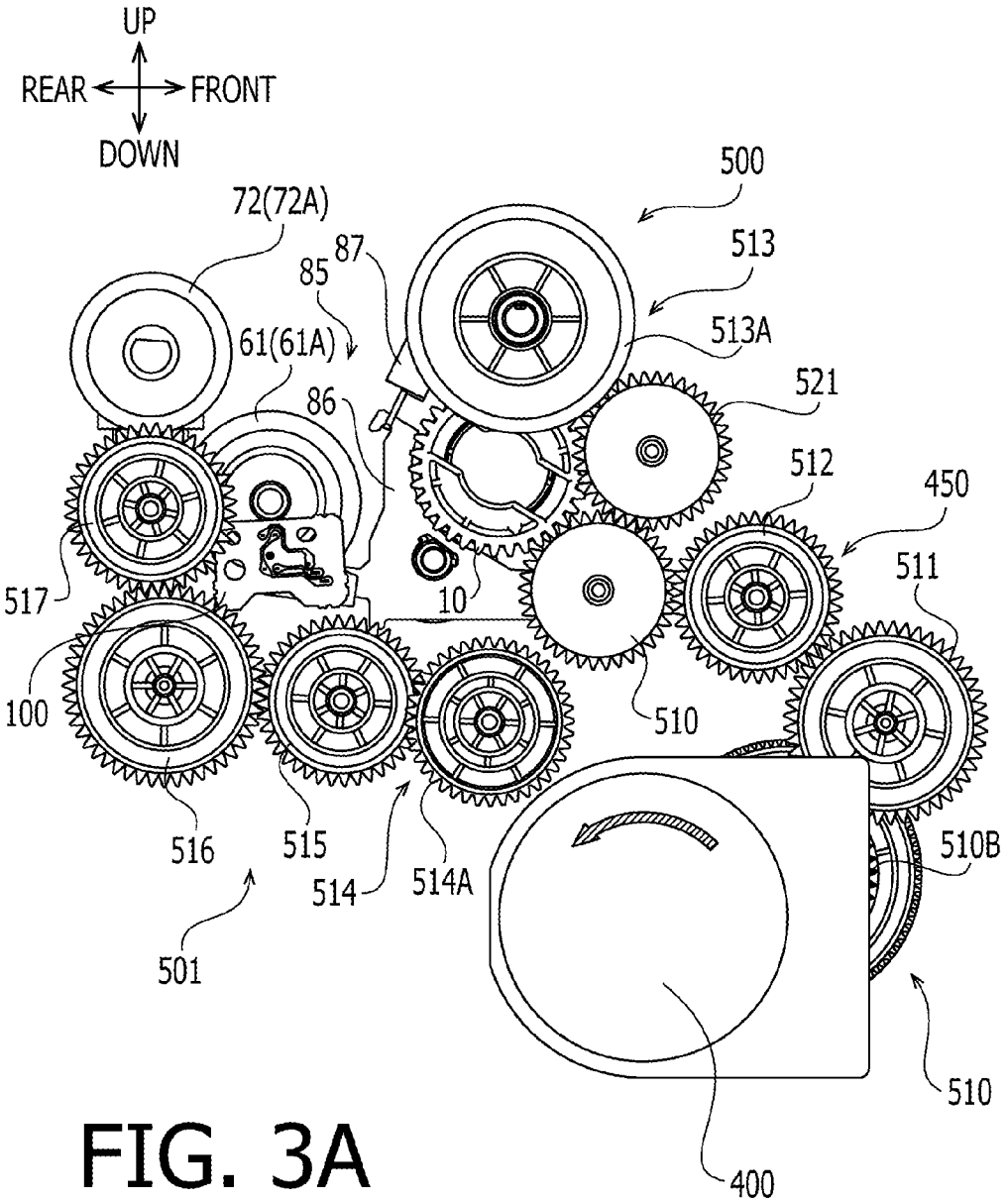
FIG. 3A is a right-side view of a first gear system and a second gear system when a motor rotates in a normal direction in the fixing unit according to the embodiment of the present disclosure.

Next, a configuration and movements of a driving system to activate or inactivate the fixing unit 11 will be described in detail. The gear train 450 includes, as shown in FIG. 3A, a first gear 510, a second gear 511, and a third gear 512.

The first gear 510 includes a first larger gear 510A and a first smaller gear 510B. The first larger gear 510A is engaged with a drive gear 400A, which rotates integrally with a rotation shaft of the motor 400. The first smaller gear 510B has a smaller diameter than a diameter of the first larger gear 510A and is disposed on a left side of the first larger gear 510A. The first larger gear 510A and the first smaller gear 510B are formed integrally and arranged coaxially on a same gear shaft.

In an upper and oblique position with respect to the first smaller gear 510B, disposed is a second gear 511, which is engaged with the first smaller gear 510B. The second gear 511 is engaged with a third gear 512, which is disposed in an upper and oblique position with respect to the second gear 511.

In a rear position with respect to the third gear 512, disposed is a swing gear 520, which is engaged with the third gear 512. Therefore, the swing gear 520 is engaged with the drive gear 400A indirectly and is movable in conjunction with the motor 400 via the gear train 450. In this regard, however, the swing gear 520 may not necessarily be engaged with the drive gear 400A indirectly but may be engaged with the drive gear 400A directly. The swing gear 520 is swingable between a first position, in which the swing gear 520 transmits the driving force from the motor 400 to a first gear system 500, and a second position, in which the swing gear 520 transmits the driving force from the motor 400 to a second gear system 501. The first gear system 500 and the second gear system 501 will be described below in detail.

Figure 3B:
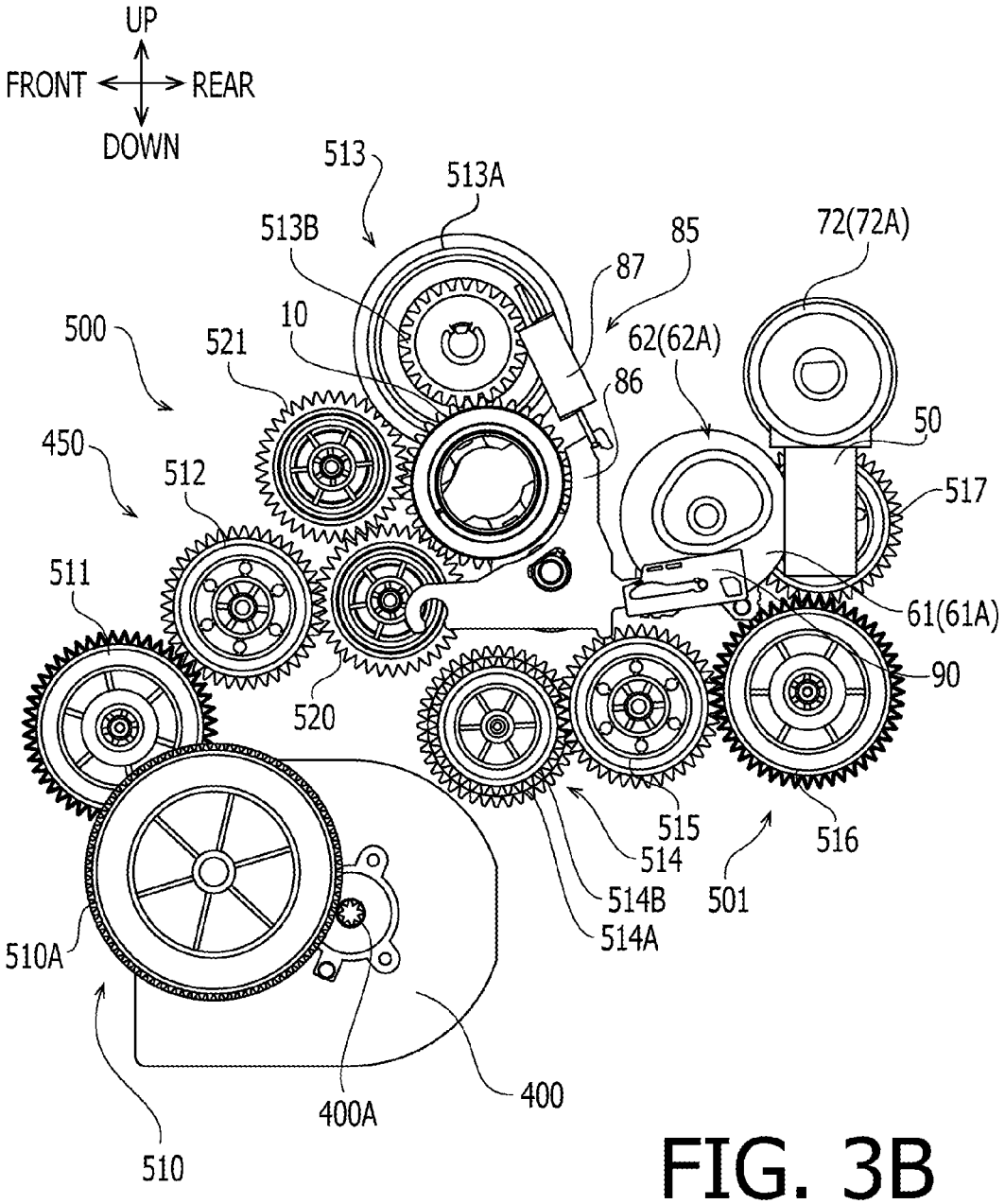
FIG. 3B is a left-side view of the first gear system and the second gear system when the motor rotates in the normal direction in the fixing unit according to the embodiment of the present disclosure.

The first gear system 500 includes the first drive gear 10 on the first roller 11A, a ninth gear 521, and a fourth gear 513. The ninth gear 521 is engageable with the swing gear 520 when the swing gear 520 is in the first position. The fourth gear 513 is disposed in an upper and oblique position with respect to the ninth gear 521 and is engaged with the ninth gear 521. The fourth gear 513 includes a second larger gear 513A and a second smaller gear 513B. The second smaller gear 513B is disposed on a right side of the second larger gear 513A and has a smaller diameter than a diameter of the second larger gear 513A. The second larger gear 513A and the second smaller gear 513B are formed integrally and arranged coaxially on a same gear shaft. As shown in FIG. 3B, the second smaller gear 513B is engaged with the first drive gear 10.

Rotation of the motor 400 is switchable between a normal direction and a reverse direction, and in the following description, normal rotation refers to rotation of the gears when the motor 400 rotates counterclockwise in FIG. 3A, and reverse rotation refers to rotation of the gears when the motor 400 rotates clockwise in FIG. 3A.

When the motor 400 rotates in the normal direction, as shown in FIG. 3A, the gears in the gear train 450 rotate, and the swing gear 520 moves to the first position to be engaged with the ninth gear 521. Thereby, the driving force produced by the motor 400 rotating in the normal rotation is transmitted to the first roller 11A through the gear train 450, the swing gear 520, and the first gear system 500 to rotate the first roller 11A. Further, the rotation of the first roller 11A rotates the second roller 11B, which is urged against the first roller 11A, and the fixing unit 11 is activated.

Next, a configuration and movements of the second gear system 501 and the cam member 62 will be described in detail. The second gear system 501 includes cam gears 61, a fifth gear 514, a sixth gear 515, a seventh gear 516, and an eighth gear 517. The fifth gear 514 includes cam gears 61, a fifth gear 514, a sixth gear 515, a seventh gear 516, and an eighth gear 517.

The fifth gear 514 includes a third larger gear 514A and a third smaller gear 514B. The third larger gear 514A is engageable with the swing gear 520. The third smaller gear 514B has a smaller diameter than a diameter of the third larger gear 514A and is disposed on a right side of the third larger gear 514A. The third larger gear 514A and the third smaller gear 514B are formed integrally and arranged coaxially on a same gear shaft.

In a rear position with respect to the fifth gear 514, disposed is the sixth gear 515, which is engaged with the third smaller gear 514B. In a rear position with respect to the sixth gear 515, disposed is the seventh gear 516, which is engaged with the sixth gear 515. In an upper position with respect to the seventh gear 516, disposed is the eighth gear 517, which is engaged with the seventh gear 516.

In an upper position with respect to the eighth gear 517, as shown in FIG. 2, disposed is a bevel gear 72A, which is one of bevel gears 72, disposed on the left. The bevel gears 72 are disposed on widthwise ends of a connecting shaft 71.

The bevel gear 72A on the left is connected with a bevel gear 72B, which is the other of the bevel gears 72, disposed on the right, through the connecting shaft 71. The bevel gears 72 are gears in a known configuration.

The bevel gear 72A on the left is engaged with the eighth gear 517 and transmits the driving force from the motor 400 to the bevel gear 72B on the right through the connecting shaft 71.

In a lower position with respect to each bevel gear 72, disposed is a worm gear 50. At an upper end of each worm gear 50, formed is a bevel gear, which is engaged with the corresponding one of the bevel gears 72. Each worm gear 50 is directly engaged with the cam gear 61, which is disposed in a frontward position with respect to the worm gear 50.

When the motor 400 rotates in the reverse direction, as shown in FIG. 4A, the swing gear 520 moves to the second position to be engaged with the third larger gear 514A. Thereby, the transmission path to the second gear system 501 is established, and the driving force produced by the motor 400 rotating in the reverse direction is transmitted to the second gear system 501. While the gears in the second gear system 501 rotate, the bevel gears 72 and the worm gears 50 rotate, and the driving force from the motor 400 is transmitted through the bevel gears 72 and the worm gears 50 to the cam gears 61 to rotate the cam members 62. Thus, the worm gears 50 are disposed in the transmission paths for the driving force in the second gear system 501. A cam member 62A, which is one of the cam members 62, on the left, rotates counterclockwise in FIG. 4B, and a cam member 62B, which is the other of the cam members 62, on the right, rotates clockwise in FIG. 5.

In the present embodiment, the rotation of the motor 400 is switchable between the normal rotation and the reverse rotation while the swing gear 520 is swingable between the first position and the second position according to the rotating direction of the motor 400. However, optionally, the motor 400 may not necessarily be rotatable in the normal and reverse directions but may be rotatable in solely one direction, while the swing gear 520 may be movable to swing between the first position and the second position by a driving means such as, for example, a solenoid, an arm, and a link.

In the following description, a configuration and movements of the cam member 62B on the right will be described. While the cam member 62A on the left is formed and configured to move similarly to the cam member 62B, detailed description of the cam member 62A on the left will be omitted.

As shown in FIG. 5, the cam member 62B is arranged to press the pressed member 90. The cam member 62B includes a first cam face 63, a second cam face 64, and a third cam face 62.

A line 63C, which extends through a rotation center C of the cam member 62B and the first cam face 63, is shorter than a line 64C, which extends through the rotation center C of the cam member 62B and the second cam face 64. The line 64C is shorter than a line 65C, which extends through the rotation center C of the cam member 62B and the third cam face 65.

When the first cam face 63 presses the pressed member 90, a first intensity of pressure is generated in the nipping area. In the following description, a condition of the nipping area when the first intensity of pressure is generated therein will be referred to as an intense nipping condition.

When the cam member 62B rotates clockwise in FIG. 5, the cam member 62B presses the pressed member 90 downward and slides on the pressed member 90 to move to a position, as shown in FIG. 6A, in which the second cam face 64 presses the pressed member 90 to a lower position with respect to the position of the pressed member 90 when the cam member 62B presses the pressed member 90 by the first cam face 63. In this condition, a second intensity of pressure is generated in the nipping area. The second intensity of the pressure to the nipping area is smaller than the first intensity of the pressure to the nipping area.

In particular, the urging member 86 is urged downward by the cam member 62B against the urging force of the spring 87, and the second roller 11B is moved in a direction to be away from the first roller 11A. Thereby, the intensity of the pressure to be generated in the nipping area is shifted from the first intensity to the second intensity. In the following description, the condition of the nipping area where the second intensity of pressure is generated in the nipping area will be referred to as a moderate nipping condition.

While the intensity of the pressure to be generated in the nipping area is the second intensity, when the motor 400 rotates further in the reverse direction, the cam member 62B rotates clockwise in FIG. 6A, pressing the pressed member 90 further downward and sliding on the pressed member 90. Thus, the cam member 62B is placed in a position, as shown in FIG. 6B, in which the third cam face 65 presses the pressed member 90 further downward than the position of the pressed member 90 when the cam member 62B presses the pressed member 90 by the second cam face 64. In this condition, a third intensity of pressure is generated in the nipping area. The third intensity of the pressure to the nipping area is smaller than the second intensity of the pressure to the nipping area. Thus, the intensity of the pressure to be generated in the nipping area is shifted from the second intensity to the third intensity.

According to the present embodiment, the intensity of the third pressure is none. In other words, no pressure is generated in the nipping area, and the first roller 11A and the second roller 11B are separated from each other. In the following description, the condition of the nipping area, where no pressure is generated in the nipping area, will be referred to as a separated condition.

However, optionally, the third intensity of the pressure may not necessarily be none, or the first roller 11A and the second roller 11B may not necessarily be separated from each other. The third intensity of the pressure may be a predetermined intensity of pressure, and the first roller 11A and the second roller 11B may contact each other. Further, the intensities of the pressure to be generated in the nipping area may not necessarily be changeable among the first, second, and third intensities but may be changeable in two, four, or more phases of intensities.

FIGS. 7A-7B show configurations of the cam members 62A, 62B. As shown in FIGS. 7A and 7B, each cam member 62 is formed to have a cylindrical rib 81, which protrudes sideward from the cam gear 61.

A rib 81A in the cam member 62A on the left includes a first slit 91, which is formed through the rib 81A. A rib 81B in the cam member 62B on the right includes a second slit 92, a third slit 93, and a fourth slit 94, which are formed through the rib 81B.

As shown in FIG. 3A, a sensor 100 to detect the first slit 91 is arranged on the rib 81A such that a part of the rib 81A is wedged in the sensor 100. Meanwhile, a sensor 200 to detect the second, third, and fourth slits 92, 93, 94 is arranged on the rib 81B such that a part of the rib 81B is wedged in the sensor 200.

The cam members 62 are in an arrangement such that the first slit 91 is detectable by the sensor 100 and the second slit 92 is detectable by the sensor 200 when the nipping area is in the intense nipping condition. Meanwhile, the third slit 93 and the fourth slit 94 are formed in the rib 81B in positions, in which the third slit 93 is detectable by the sensor 200 when the nipping area is in the moderate nipping condition, and in which the fourth slit 94 is detectable by the sensor 200 when the nipping area is in the separated condition. Thus, the sensor 100 and the sensor 200 may detect the condition of the cam members 62 by detecting the first slit 91, the second slit 92, the third slit 93, and the fourth slit 94.

Behaviors of the motor 400 are controlled by a controller 300 (see FIG. 1) disposed in the chassis 3 based on the detected results from the sensor 100 and the sensor 200 so that the phase of the cam members 62 is adjusted. The controller may include a central processing unit (CPU), a random access memory (RAM), a read-only memory (ROM), and an input/output (I/O) circuit. The controller computes to process various types of information to control the behaviors of each component in the image forming apparatus 1 based on programs and information stored in the ROM.

A method to control the behaviors of the motor 400 will be described below with reference to FIG. 8. When the motor 400 is in the reverse rotation, the sensor 100 may detect the first slit 91, and the sensor 200 may detect the second slit 92, as indicated by arrow (a) in FIG. 8. When the sensor 100 detects the first slit 91 and the sensor 200 detects the second slit 92, the controller 300 stops the reverse rotation of the motor 400. Thereby, the nipping area is placed in the intense nipping condition. When the image forming apparatus 1 having been powered off is powered on, the controller 300 controls the rotation of the motor 400 to place the nipping area in the intense nipping condition.

While the motor 400 is in the reverse rotation, the sensor 200 may detect the third slit 93, as indicated by arrow (b) in FIG. 8. When the sensor 200 detects the third slit 93, the controller stops the reverse rotation of the motor 400. Thereby, the nipping area is placed in the moderate nipping condition. Further, while the motor 400 is in the reverse rotation, the sensor 200 may detect the fourth slit 94, as indicated by arrow (c) in FIG. 8. When the sensor 200 detects the fourth slit 94, as indicated by arrow (c) in FIG. 8, the controller stops the reverse rotation of the motor 400. Thereby, the nipping area is placed in the separated condition.

According to this control by the controller 300, it may not be necessary that a detectable member to be detected by the sensor 100 or the sensor 200 is provided independently from the cam members 62. In other words, in the less complicated configuration, the fixing unit 11 may be activated while the cam members 62 press the pressed members 90.

Next, movements of the worm gear 50 will be described below. While the motor 400 is in the reverse rotation, and while the nipping area is in the intense nipping condition or in the moderate nipping condition, when the rotation of the motor 400 is switched to the normal rotation to activate the fixing unit 11, the swing gear 520 is moved to swing from the second position to the first position. Thereby, as shown in FIG. 3A, the fifth gear 514 is disengaged from the swing gear 520, which is connected with the motor 400, and the second gear system 501 is disconnected. Accordingly, the cam members 62 are not driven by the worm gears 50, but, as shown in FIGS. 6A and 6B, the cam members 62 being affected by the springs 87 through the pressed members 90 tend to rotate counterclockwise.

The cam members 62 tend to rotate counterclockwise as shown in FIGS. 6A, 6B in reasons that the direction to urge the pressed members 90 by the springs 87 against the cam members 62 inclines upper-frontward with respect to the line 64C in FIG. 6A and that the rotating moment to rotate the cam members 62 counterclockwise is applied to the cam members 62. Similarly, the cam members 62 tend to rotate counterclockwise in reasons that the direction to urge the pressed members 90 by the springs 87 against the cam members 62 inclines upper-frontward with respect to the line 65C in FIG. 6B and that the rotating moment to rotate the cam members 62 counterclockwise is applied to the cam members 62.

Meanwhile, as shown in FIG. 9, the cam gears 61 are engaged with the worm gears 50, which are not rotating when the motor 400 is in the normal rotation. Therefore, the rotation force in the cam members 62 produced by the urging force from the springs 87 is transmitted to the worm gears 50 through the cam gears 61. In this regard, however, the rotation force in the cam members 62 are absorbed in the worm gears 50, and the worm gears 50 are maintained stationary without being moved by the rotating force of the cam members 62.

Therefore, the cam members 62 are restricted from being rotated counterclockwise and are sustained at the condition when the motor 400 is in the normal rotation. In other words, the worm gears 50 sustain the cam members 62. With this sustaining mechanism, the fixing unit 11 may be activated while the nipping area is in the intense nipping condition or the moderate nipping condition, that is, while the cam members 62 press the pressed members 90 and the swing gear 520 is in the first position.

Moreover, the fixing unit 11 and the cam members 62 may be driven by the movement of the motor 400 alone, in other words, by switching the rotating directions of the single motor 400. Therefore, in the less complicated configuration, the fixing unit 11 may be activated while the cam members 62 press the pressed members 90 and the swing gear 520 is in the first position.

Further, while each of the cam members 62 is arranged correspondingly to each urging device 85, which is arranged on each widthwise end of the second roller 11B, and while the worm gear 50 is arranged correspondingly to each of the cam members 62, the cam members 62 may be restrained from rotating while the cam members 62 press the pressed members 90 more securely than a configuration, in which a single worm gear 50 alone is provided.

Further, with the worm gear 50 is engaged with the cam gear 61, which is integrally formed with the cam member 62, the rotating force in the cam member 62 may be directly transmitted to the worm gear 50. Therefore, while the cam members 62 press the pressed members 90, the cam members 62 may be restrained from rotating more securely than the cam members, of which rotating force is transmitted to the worm gears 50 indirectly through other gears.

Although an example of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, in the above-described embodiment, the cam members 62 tend to rotate counterclockwise in FIGS. 6A and 6B while the nipping area is in the intense nipping condition or in the moderate nipping condition and when the motor 400 tends to rotate in the normal direction. However, the cam members 62 may not necessarily be configured to rotate counterclockwise. For example, the cam members 62 may be configured to tend to rotate clockwise while the nipping area is in the intense nipping condition or in the moderate nipping condition and when the motor 400 tends to rotate in the normal direction.

For another example, the worm gears 50 to sustain or lock the cam members 62 may be replaced with a one-way gear system 170 (see FIG. 10). The one-way gear system 170 may include known one-way gears 73, which are enabled to rotate solely in one direction, and a connecting part 71, which connects the one-way gears 73 with each other.

While the motor 400 is in the reverse rotation, and when the nipping area is in the intense nipping condition or the moderate nipping condition, the motor 400 may tend to rotate in the normal direction, and the fixing unit 11 may tend to be activated. In this regard, the cam members 62 being urged by the springs 87 through the pressed members 90 may tend to rotate.

Meanwhile, the cam gears 61 are engaged with the one-way gears 73, and the one-way gears 73 may not allow rotation of the cam members 62. Therefore, even when the rotating force in the cam members 62, which is produced by the urging force from the springs 87, is transmitted to the one-way gears 73, the one-way gears 73 may not be rotated or activated.

Thus, the cam members 62 may be restricted from rotating and sustained at the intense or moderate nipping condition. Therefore, while the cam members 62 press the pressed members 90, and when the swing gear 520 is in the first position, the fixing unit 11 may be activated.

Moreover, while each one-way gear 73 is engaged with the cam gear 61, which is formed integrally with the cam member 62, the rotating force in the cam members 62 may be transmitted to the one-way gears 73 directly. Therefore, while the cam members 62 press the pressed members 90, and when the swing gear 520 is in the first position, the cam members 62 may be sustained and restricted from rotating more securely than cam members, of which rotating force is transmitted to the one-way gears 73 indirectly through additional gears.

For another example, the worm gears 50 and the one-way gear system 170 described in the above embodiment may not necessarily be provided but may be replaced with another configuration. For example, as shown in FIG. 11, each cam member 62 may have a cam face 66, which is arranged to face with the pressed member 90 and formed to stretch along the pressed member 90, so that the cam face 66 may press the pressed member 90. The cam face 66 may stretch along a direction orthogonal to the urging direction of the urging members 86.

While a reaction force from the pressed member 90 is applied to the cam face 66, the cam member 62 may be affected by a rotating moment that tends to rotate the cam member 62 about the rotation center C. Further, the cam member 62 may be affected by two kinds of moments, which tend to rotate the cam member 62 clockwise and counterclockwise in FIG. 11.

In this regard, the cam face 66 forms a flat surface, which stretches along the pressed member 90. Therefore, a sum of the two kinds of moments about the rotation center C may be, but not necessarily be, zero. In other words, the sum of the two kinds of moments about the rotation center C may be small enough to sustain the cam member 62 from rotating about the rotation center C.

With this configuration, the cam members 62 may be restrained from rotating but maintained at the nipping condition. Therefore, while the cam members 62 press the pressed members 90, and when the swing gear 520 is in the first position, the fixing unit 11 may be activated.

What is claimed is:

1. An image forming apparatus, comprising:

a motor;

a motor gear disposed on the motor;

a first conveyer;

a first gear system connected with the first conveyer;

a second conveyer arranged to oppose the first conveyer;

a second gear system;

a first pressed member;

a first cam member comprising a first cam face and a second cam face, a first distance between the first cam face and a rotation center of the first cam member being shorter than a second distance between the second cam face and the rotation center of the first cam member, the first cam member being arranged to contact the first pressed member;

a first cam gear disposed on the first cam member and configured to rotate integrally with the first cam member;

a first urging member arranged to contact the first pressed member, the first urging member urging the first pressed member toward the first cam member, the first urging member being connected with the second conveyer, the first urging member urging the second conveyer toward the first conveyer;

a swing gear engaged with the motor gear, the swing gear being configured to be driven by the motor, the swing gear being configured to swing between a first position, in which the swing gear engages with the first gear system, and a second position, in which the swing gear engages with the second gear system, wherein the swing gear is configured to drive the first conveyer via the first gear system when the swing gear is at the first position, and wherein the swing gear is configured to drive the first cam gear via the second gear system when the swing gear is at the second position; and a first engaging gear directly engaged with the first cam gear, the first engaging gear being one of a worm gear and a one-way gear, the first engaging gear being configured to be driven by the swing gear via the second gear system, the first engaging gear being configured to be driven by the second gear system and drive the first cam gear when the swing gear is in the second position, the first engaging gear being configured to restrict rotation of the first cam gear when the swing gear is in the first position.

2. The image forming apparatus according to claim 1, wherein the first pressed member, the first cam member, the first cam gear, the first urging member, and the first engaging gear are arranged at one end of the second conveyer;

wherein the image forming apparatus further comprises:

a second pressed member;

a second cam member comprising a third cam face and a fourth cam face, a third distance between the third cam face and a rotation center of the second cam member being shorter than a fourth distance between the fourth cam face and the rotation center of the second cam member, the second cam member being arranged to contact the second pressed member;

a second cam gear disposed on the second cam member and configured to rotate integrally with the second cam member;

a second urging member arranged to contact the second pressed member, the second urging member urging the second pressed member toward the second cam member, the second urging member being connected with the second conveyer, the second urging member urging the second conveyer toward the first conveyer; and a second engaging gear directly engaged with the second cam gear, the second engaging gear being one of a worm gear and a one-way gear, the second engaging gear being configured to be driven by the second gear system and drive the second cam gear when the swing gear is in the second position and to be stationary when the swing gear is in the first position, wherein the second pressed member, the second cam member, the second cam gear, the second urging member, and the second engaging gear are arranged at the other end of the second conveyer;

wherein the image forming apparatus further comprises:

a first detector; and a second detector, wherein the first cam member has a slit, the slit being configured to oppose the first detector, and the second cam member has a plurality of slits, the plurality of slits being configured to oppose the second detector.

3. The image forming apparatus according to claim 2, wherein the first detector is configured to detect the slit of the first cam member, and the second detector is configured to detect the plurality of slits of the second cam member; and wherein the image forming apparatus further comprises a controller configured to control the motor based on detection by the first detector and the second detector.

4. The image forming apparatus according to claim 1, further comprising:

a second pressed member;

a second cam member comprising a third cam face and a fourth cam face, a third distance between the third cam face and a rotation center of the second cam member being shorter than a fourth distance between the fourth cam face and the rotation center of the second cam member, the second cam member being arranged to contact the second pressed member;

a second cam gear disposed on the second cam member and configured to rotate integrally with the second cam member;

a second urging member arranged to contact the second pressed member, the second urging member urging the second pressed member toward the second cam member, the second urging member being connected with the second conveyer, the second urging member urging the second conveyer toward the first conveyer;

a second engaging gear directly engaged with the second cam gear, the second engaging gear being one of a worm gear and a one-way gear, the second engaging gear being configured to be driven by the second gear system and drive the second cam gear when the swing gear is in the second position and to be stationary when the swing gear is in the first position;

a first detector; and a second detector, wherein the first pressed member, the first cam member, the first cam gear, the first urging member, and the first engaging gear are arranged at one end of the second conveyer;

wherein the second pressed member, the second cam member, the second cam gear, the second urging member, and the second engaging gear are arranged at the other end of the second conveyer; and wherein the first cam member has a single slit, the single slit being configured to oppose the first detector, and the second cam member has a plurality of slits, the plurality of slits being configured to oppose the second detector.

5. The image forming apparatus according to claim 4, wherein the first detector is configured to detect the single slit of the first cam member, and the second detector is configured to detect the plurality of slits of the second cam member; and wherein the image forming apparatus further comprises a controller configured to control the motor based on detection by the first detector and the second detector.

6. The image forming apparatus according to claim 1, wherein the first conveyer is a roller extending between a first side and a second side along a predetermined direction, the first conveyer being configured to rotate about an axis extending along the predetermined direction;

wherein the second conveyer is another roller extending between the first side and the second side along the predetermined direction, the second conveyer being configured to rotate about another axis extending along the predetermined direction;

wherein the first cam member is on the first side of the first cam gear along the predetermined direction and configured to rotate about a rotation axis extending along the predetermined direction through the rotation center;

wherein the image forming apparatus further comprises a first protrusion provided on the second side of the first cam gear along the predetermined direction, and the first protrusion protruding sideward from the first cam gear toward the second side;

wherein the first urging member is connected with one end of the second conveyer on the second side along the predetermined direction;

wherein the image forming apparatus further comprises:

a second pressed member;

a second cam member comprising a third cam face and a fourth cam face, a third distance between the third cam face and a second rotation center of the second cam member being shorter than a fourth distance between the fourth cam face and the rotation center of the second cam member, the second cam member being arranged to contact the second pressed member;

a second cam gear disposed on the second cam member and configured to rotate integrally with the second cam member;

a second urging member arranged to contact the second pressed member, the second urging member urging the second pressed member toward the second cam member, the second urging member being connected with the other end of the second conveyer on the first side along the predetermined direction, the second urging member urging the second conveyer toward the first conveyer; and a second engaging gear directly engaged with the second cam gear, the second engaging gear being one of a worm gear and one-way gear, the second engaging gear being configured to be driven by the second gear system and drive the second cam gear when the swing gear is in the second position and to be stationary when the swing gear is in the first position;

wherein the second cam member is on the second side of the second cam gear along the predetermined direction, the second cam gear being configured to rotate about a rotation axis extending along the predetermined direction through the second rotation center;

wherein the image forming apparatus further comprises a second protrusion provided on the first side of the second cam gear along the predetermined direction, the second protrusion protruding sideward from the second cam gear toward the first side;

wherein the second pressed member, the second cam member, the second cam gear, the second protrusion, the second urging member, and the second engaging gear are arranged at the other end of the second conveyer on the first side along the predetermined direction;

wherein the first protrusion has one of a single slit and a plurality of slits; and wherein the second protrusion has the other of the single slit and the plurality of slits.

7. The image forming apparatus according to claim 1, wherein the first cam member is arranged to contact the first pressed member in a both a first condition, in which the first cam face contacts the first pressed member, and a second condition, in which the second cam face contacts the first pressed member.

8. The image forming apparatus according to claim 1, wherein the first cam member comprises a third cam face, a third distance between the third cam face and the rotation center of the first cam member being longer than the second distance; and wherein the first conveyer and the second conveyer are separated from each other when the third cam face contacts the first pressed member.

9. An image forming apparatus, comprising:

a motor;

a first conveyer configured to be driven by a driving force from the motor, the first conveyer being configured to convey a recordable medium;

a second conveyer configured to form a nipping area to nip the recordable medium in conjunction with the first conveyer;

an urging member configured to urge one of the first and second conveyers toward the other of the first and second conveyers;

a cam member configured to be driven by the driving force from the motor to affect the urging member, the cam member being configured to change intensities of pressure to be generated in the nipping area between a first intensity and a second intensity greater than the first intensity, wherein the second conveyer is in contact with the first conveyer when the first intensity of pressure is generated in the nipping area, and wherein the second conveyer is in contact with the first conveyer when the second intensity of pressure is generated in the nipping area;

a first gear system configured to transmit the driving force from the motor to the first conveyer;

a second gear system configured to transmit the driving force from the motor to the cam member;

an engaging member engaged with a cam gear disposed on the cam member to rotate integrally with the cam member, the engaging member being one of a worm gear and a one-way gear, the one-way gear having an inner structure that enables the one-way gear to rotate in a first direction and restrict rotation of the one-way gear in a second direction opposite from the first direction; and a swing gear configured to swing between a first position, in which the swing gear transmits the driving force from the motor to the first gear system, and a second position, in which the swing gear transmits the driving force from the motor to the second gear system, wherein the swing gear is configured to drive the first conveyer via the first gear system when the swing gear is at the first position, and wherein the swing gear is configured to drive the cam gear via the second gear system when the swing gear is at the second position.

10. The image forming apparatus according to claim 9, wherein the engaging member directly engages with the cam gear disposed on the cam member.

11. The image forming apparatus according to claim 9, wherein the urging member is arranged at both ends of one of the first conveyer and the second conveyer;

wherein the cam member is arranged correspondingly to each of the urging members; and wherein the engaging member is arranged correspondingly to each of the cam members.

12. The image forming apparatus according to claim 9, wherein the engaging member includes a worm gear arranged in a transmission path in the second gear system.

13. The image forming apparatus according to claim 12, wherein the worm gear is arranged to be engaged with the cam gear.

14. The image forming apparatus according to claim 9, wherein the engaging member includes a one-way gear arranged in a transmission path in the second gear system.

15. The image forming apparatus according to claim 14, wherein the one-way gear is arranged to be engaged with the cam gear.

16. The image forming apparatus according to claim 9, wherein a rotating direction of the motor is switchable between a normal direction and a reverse direction; and wherein the swing gear is movable to swing between the first position and the second position according to the rotating direction of the motor.

17. The image forming apparatus according to claim 9, wherein the cam member is arranged to be rotatable; and wherein the image forming apparatus further comprises:

a detector configured to detect a phase of the cam member;

a detectable part arranged in the cam member, the detectable part being detectable by the detector; and a controller configured to control the motor based on the phase of the detectable part detected by the detector.

18. The image forming apparatus according to claim 17, wherein the detectable part is a slit formed in the cam member.

19. The image forming apparatus according to claim 9, wherein the cam member is configured to change the intensities of pressure to be generated in the nipping area among the first intensity, the second intensity, and no intensity, in which the first conveyer and the second conveyer are separated from each other.

20. An image forming apparatus, comprising:

a motor;

a motor gear disposed on the motor;

a first conveyer;

a first gear system connected with the first conveyer;

a second conveyer arranged to oppose the first conveyer;

a second gear system connected with the second conveyer;

a first pressed member;

a first cam member comprising a first cam face and a second cam face, a first distance between the first cam face and a rotation center of the first cam member being shorter than a second distance between the second cam face and the rotation center of the first cam member, the first cam member being arranged to contact the first pressed member;

a first cam gear disposed on the first cam member and configured to rotate integrally with the first cam member;

a first urging member arranged to contact the first pressed member, the first urging member urging the first pressed member toward the first cam member, the first urging member being connected with the second conveyer, the first urging member urging the second conveyer toward the first conveyer;

a swing gear engaged with the motor gear, the swing gear being configured to swing between a first position, in which the swing gear engages with the first gear system, and a second position, in which the swing gear engages with the second gear system; and a first engaging gear directly engaged with the first cam gear, the first engaging gear being one of a worm gear and a one-way gear, the first engaging gear being configured to be driven by the second gear system and drive the first cam gear when the swing gear is in the second position and to be stationary when the swing gear is in the first position, wherein the first conveyer is a roller extending between a first side and a second side along a predetermined direction, the first conveyer being configured to rotate about an axis extending along the predetermined direction;

wherein the second conveyer is another roller extending between the first side and the second side along the predetermined direction, the second conveyer being configured to rotate about another axis extending along the predetermined direction;

wherein the first cam member is on the first side of the first cam gear along the predetermined direction and configured to rotate about a rotation axis extending along the predetermined direction through the rotation center;

wherein the image forming apparatus further comprises a first protrusion provided on the second side of the first cam gear along the predetermined direction, and the first protrusion protruding sideward from the first cam gear toward the second side;

wherein the first urging member is connected with one end of the second conveyer on the second side along the predetermined direction;

wherein the image forming apparatus further comprises:

a second pressed member;

a second cam member comprising a third cam face and a fourth cam face, a third distance between the third cam face and a second rotation center of the second cam member being shorter than a fourth distance between the fourth cam face and the rotation center of the second cam member, the second cam member being arranged to contact the second pressed member;

a second cam gear disposed on the second cam member and configured to rotate integrally with the second cam member;

a second urging member arranged to contact the second pressed member, the second urging member urging the second pressed member toward the second cam member, the second urging member being connected with the other end of the second conveyer on the first side along the predetermined direction, the second urging member urging the second conveyer toward the first conveyer; and a second engaging gear directly engaged with the second cam gear, the second engaging gear being one of a worm gear and a one-way gear, the second engaging gear being configured to be driven by the second gear system and drive the second cam gear when the swing gear is in the second position and to be stationary when the swing gear is in the first position;

wherein the second cam member is on the second side of the second cam gear along the predetermined direction, the second cam gear being configured to rotate about a rotation axis extending along the predetermined direction through the second rotation center;

wherein the image forming apparatus further comprises a second protrusion provided on the first side of the second cam gear along the predetermined direction, the second protrusion protruding sideward from the second cam gear toward the first side;

wherein the second pressed member, the second cam member, the second cam gear, the second protrusion, the second urging member, and the second engaging gear are arranged at the other end of the second conveyer on the first side along the predetermined direction;

wherein the first protrusion has one of a single slit and a plurality of slits; and wherein the second protrusion has the other of the single slit and the plurality of slits.

* * * * *